US006289175B1

(12) United States Patent
De' Longhi

(10) Patent No.: US 6,289,175 B1
(45) Date of Patent: Sep. 11, 2001

(54) INDEPENDENTLY OPERATING PORTABLE RADIATOR

(75) Inventor: Giuseppe De' Longhi, Treviso (IT)

(73) Assignee: De'Longhi S.P.A., Treviso (IT)

( * ) Notice: Subject to any disclaimer, the term of this patent is extended or adjusted under 35 U.S.C. 154(b) by 0 days.

(21) Appl. No.: 09/488,399

(22) Filed: Jan. 20, 2000

(30) Foreign Application Priority Data

Feb. 17, 1999 (IT) ..... MI99A0314

(51) Int. Cl.[7] ..... F24H 3/00

(52) U.S. Cl. ..... 392/357; 392/378; 392/373; 392/365; 165/130

(58) Field of Search ..... 392/357, 358, 392/359, 347, 360, 365, 373–374, 377–378; 165/128–131

(56) References Cited

U.S. PATENT DOCUMENTS 1,757,534 * 5/1930 Lindstrom et al. ..... 165/128
1,840,598 * 1/1932 Murray ..... 392/378
2,439,945 * 4/1948 Morton ..... 165/130
2,455,688 * 12/1948 Malickson ..... 165/128
5,685,365 * 11/1997 De'Longhi ..... 165/130

FOREIGN PATENT DOCUMENTS

1032912 * 6/1958 (DE) .
965801 * 12/1999 (EP) .
2198609 * 5/1974 (FR) .
2325000 * 5/1977 (FR) .
2407437 * 6/1979 (FR) .
2478277 * 9/1981 (FR) .

* cited by examiner

*Primary Examiner*—John A. Jeffery
(74) *Attorney, Agent, or Firm*—Herbert Dubno

(57) ABSTRACT

A portable radiator has a radiator body whose radiating members are defined by first and second metal plates which together define central portions in which a heating fluid is displaced convectively, the radiating members communicating with each other through passages in the central body. A heating unit is provided in the central body for heating the fluid and an additional heating member is provided in seats formed by the heating members outwardly of the central body for heating air.

15 Claims, 6 Drawing Sheets

INDEPENDENTLY OPERATING PORTABLE RADIATOR

FIELD OF THE INVENTION

The present invention relates to an independently operating portable radiator.

BACKGROUND OF THE INVENTION

At present, as known, there are several types of independently operating and portable radiators such as radiators wherein circulating diathermal oil is heated by an electric resistance arranged inside the radiator casing.

These diathermal oil radiators usually have a number of radiating members mutually hydraulically connected by means of upper and lower hubs.

Each radiating member is constituted by a first and a second metal plate mutually associated in order to define a central portion wherein the diathermal oil circulates. In each radiating member, the surface portion extending outside the central portion where the oil circulates may have folds and/or channels and/or apertures on the double sheet metal defined by the mutual connection of the first and second plates. Those folds and/or channels and/or apertures tend to reduce the heat transmission from the central portion to the periphery of each radiating member.

In this manner the peripheral surfaces of the radiator are at a lower temperature than that of the heated oil circulating in the central portion. In spite of its good operation, this type of radiator has the inconvenience of being slow and of producing a perceptible convective motion when it is turned on and consequently of being slow at radiating heat to the surroundings. It usually takes in fact at least 7 to 8 minutes to create a convective motion because first the electrical resistance must heat up and then the diathermal oil and the radiating member array. Furthermore, these oil radiators have a relatively high manufacturing cost and accordingly a high retail price.

In fact, the provision of a grid above the radiator casing requires added work of stamping, stocking, degreasing, painting and assembling of the grid thereby increasing costs due to the materials and to the added production steps.

OBJECTS OF THE INVENTION

The aim of the present invention is to eliminate the above cited drawbacks of the prior art radiators operating with diathermal oil.

An important object of the invention is to provide an independently operating portable radiator adapted to generate a convective motion which is perceptible by the user in a very short time and at any rate shorter than that of the conventional radiators.

A further object of the invention is to provide an independently operating and portable radiator allowing to provide the grid directly on the upper portion of the radiating members of the radiator casing in order to eliminate any supplemental manufacturing step and to reduce the manufacturing cost and therefore the retail price of the radiator.

Still a further object of the invention is to provide an independently operating and portable radiator allowing a greater convective motion and therefore a greater thermal exchange, with the same capacity of prior art radiators.

Still a further object of the invention is to provide an independently operating and portable radiator allowing a greater circulation of ambient air and accordingly less time required to heat the ambient, as well as a considerable saving in the raw material needed to manufacture the radiator and therefore a lower weight and an easier handling of the user.

SUMMARY OF THE INVENTION

The above aim, as well as the above and other objects that will be more apparent hereinafter, are achieved by an independently operating portable radiator comprising a body having a plurality of radiating members each defined by at least a first metal plate and a second metal plate mutually associated and by at least one central portion wherein fluid heated by heating means, at a preset temperature circulates, said radiating members being mutually connected through passage hubs for said heated fluid for its circulation inside said body, said radiator further comprising, in at least one region of the surface of the radiating members external to said central portion wherein said heated fluid circulates, additional heating means at least for heating the surrounding air.

BRIEF DESCRIPTION OF THE DRAWING

Further characteristics and advantages of the invention will be more apparent by the following description of the independently operating and mobile radiator, according to the invention illustrated, by way of example in the accompanying drawing wherein.

SPECIFIC DESCRIPTION

Figure 1:
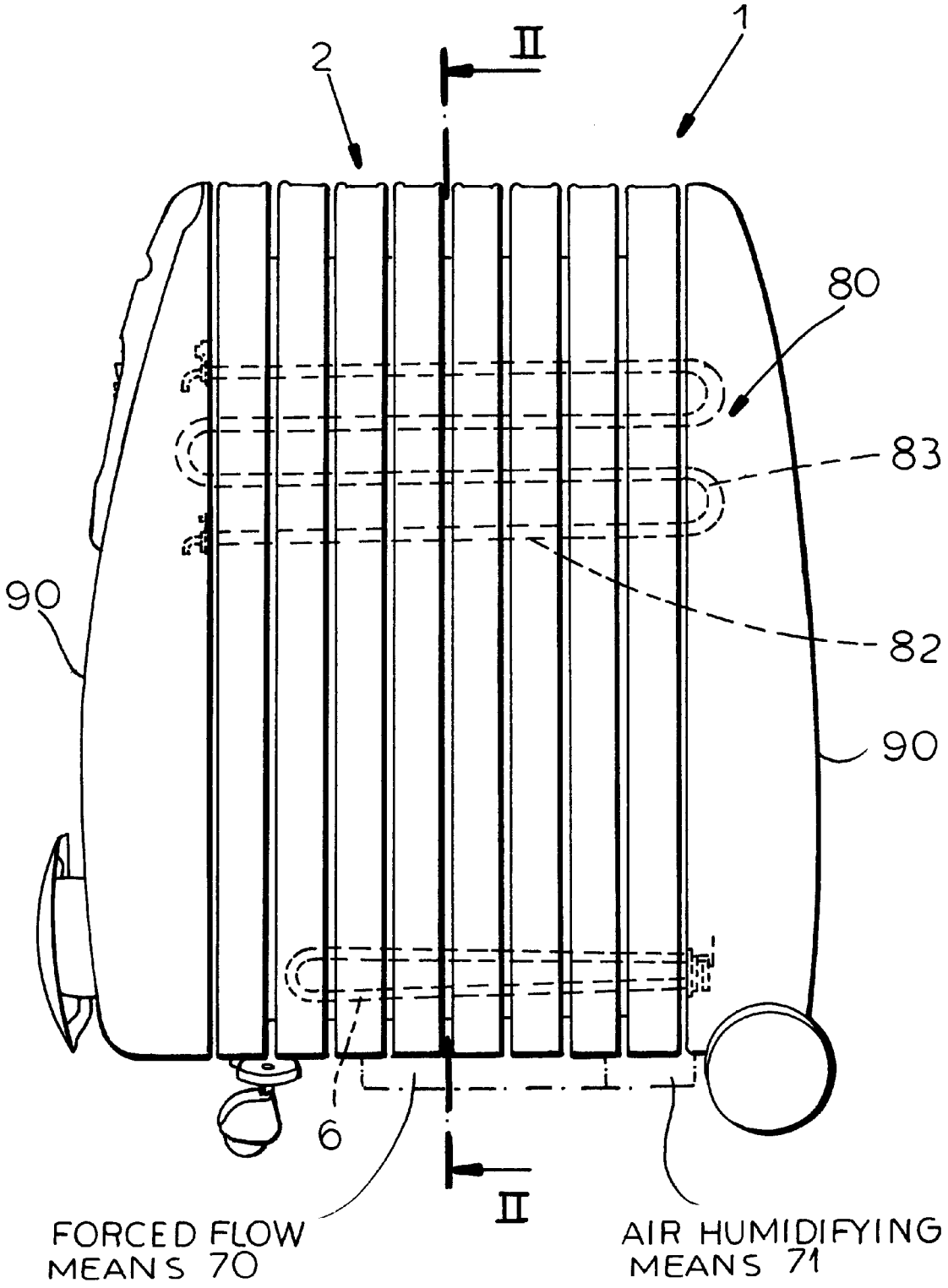
FIG. 1 is a side elevational view of the radiator showing, in broken lines, the diathermal oil heating means and the additional heating means according to the invention.
Figure 2:
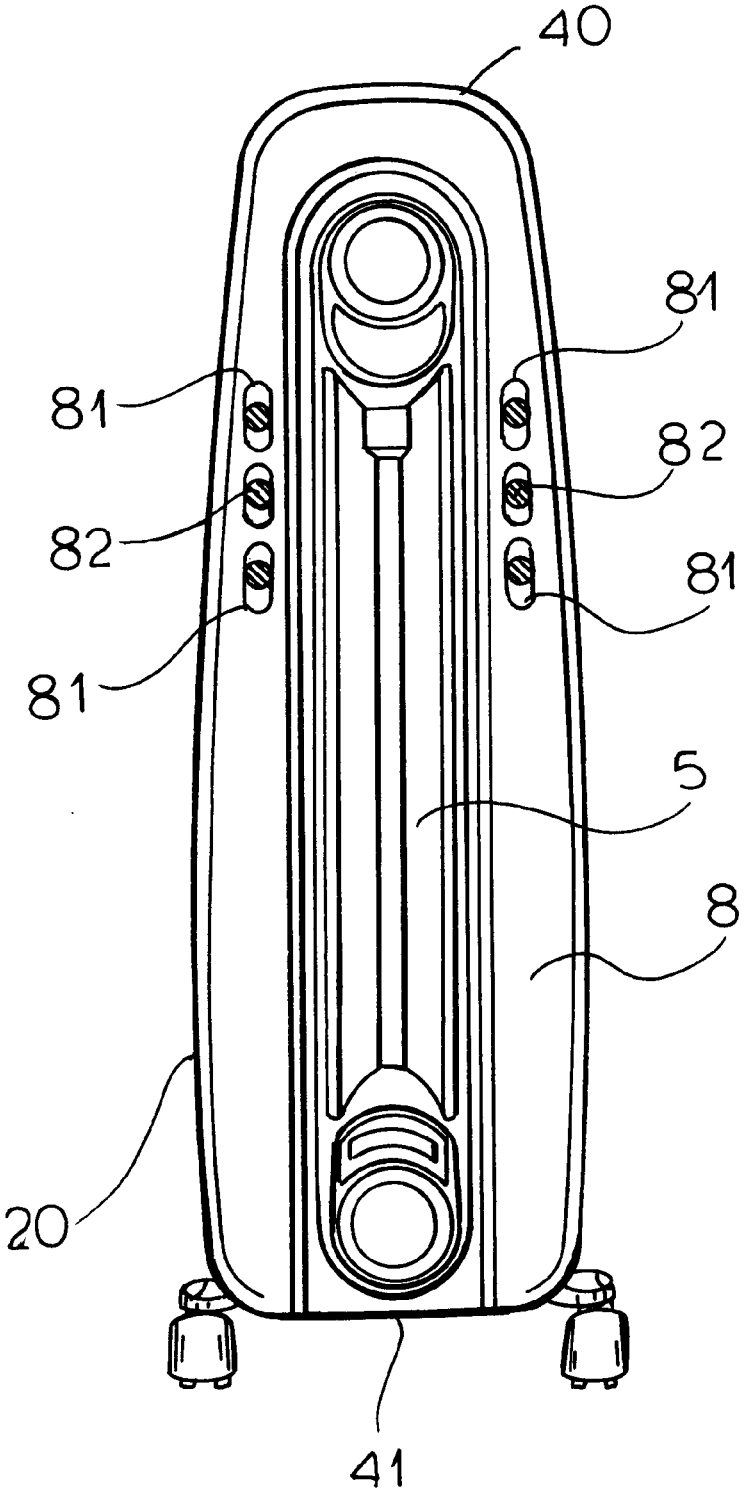
FIG. 2 is a sectional view according to section line II—II of FIG. 1, according to the invention.
Figure 3:
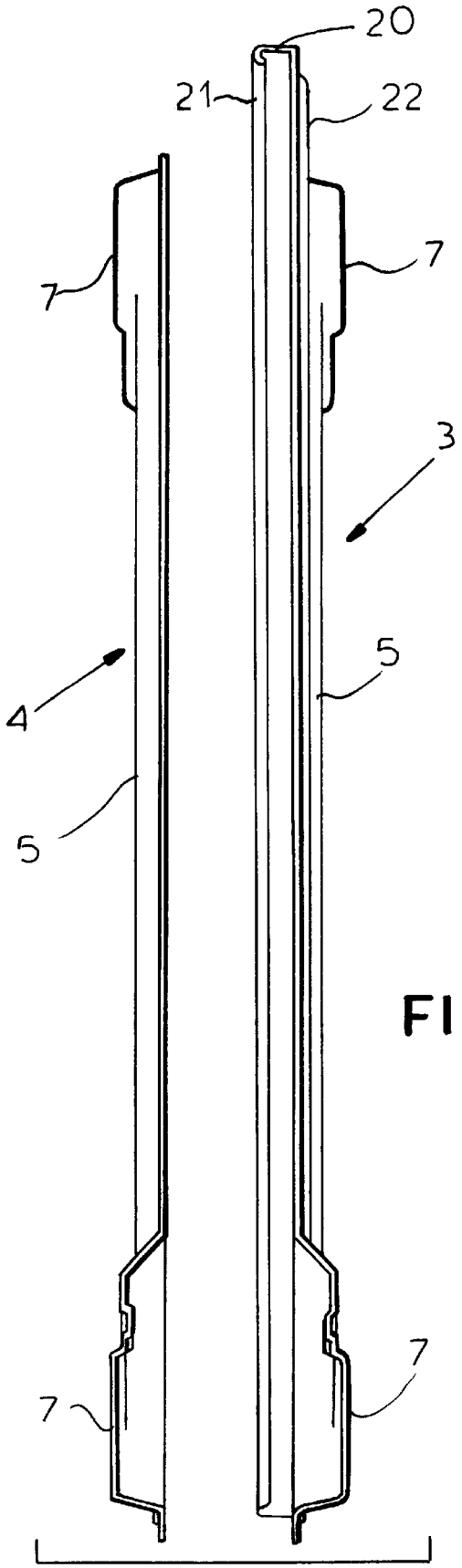
FIG. 3 is a side elevational view of a portion of the radiator body according to the invention.

As will be apparent from the drawing, the independently operating portable radiator 1 comprises a body 2 defined by a plurality of radiating members each defined by at least a first metal and a second metal plates 3, 4 and by at least one central portion 5 wherein fluid heated at a preset temperature by heating means, namely a resistance 6, circulates.

The radiating members are mutually communicating through hubs 7 for the passage of heated fluid, for example a diathermal oil, allowing the fluid to internally circulate inside the body 2 of the radiator.

Advantageously, the radiator comprises, in at least one region 8 of the surface of the radiating members, external to said central portion 5 wherein the heated fluid circulates, additional heating means globally designated by 80.

Some of said radiating members have, on the surface, at least one aperture 81 adapted to define, together with the apertures of the adjacent radiating members, a seat wherein the additional heating means 80 are arranged.

In particular, in the illustrated embodiment, all the radiating members have not only an aperture 81 but rather three apertures 81 mutually aligned along the vertical extension of the radiating members.

In this manner the additional heating means, defined by a reinforced electrical resistance 82, may extend, as shown, inside the seat defined by the aperture 81 assembly arranged on three superimposed lines and on both sides of the radiator body.

Since the apertures 81 have an elliptic shape, it is possible to arrange in the selected apertures, two branches of the resistance and in particular its bent portion 83.

Because of the particular shape of the radiating members, as better explained heretofore, the reinforced resistances 82 are not accessible by the user and are hidden from view in order not to influence the aesthetic aspect of the radiator.

In particular, the arrangement of the resistances 82 allows, when they are turned on, to generate an immediate thermal exchange with the surrounding air thus generating a convective motion which is perceptible in about one minute or a little longer.

The resistances 6, that are adapted to heat the diathermal oil, and the additional resistances 82 may be activated at the same time providing the radiator with a total power equal to the power of the traditional oil radiators.

Furthermore, the size and the power of resistances 82 is designed to respect the thermal equilibrium required by statutory regulations and by the intrinsic features of the radiating members of the radiator.

According to a preferred embodiment of the invention, each radiating member has at least one region of its surface 8, which is external to the central portion 5 where the diathermal oil circulates, having a wall thickness "S" substantially equal to the wall thickness of the first and second metal plates 3 or 4.

In particular, the wall thickness "S" is made equal to the wall thickness of the first and second metal plates 3 or 4 by the first metal plate 3 having greater size than the second metal plate 4 and comprising a seat means defined by a seat 10, having a size substantially similar to the size of the second metal plate 4, allowing the second metal plate 4 to be arranged in the seat 10.

Figure 7:
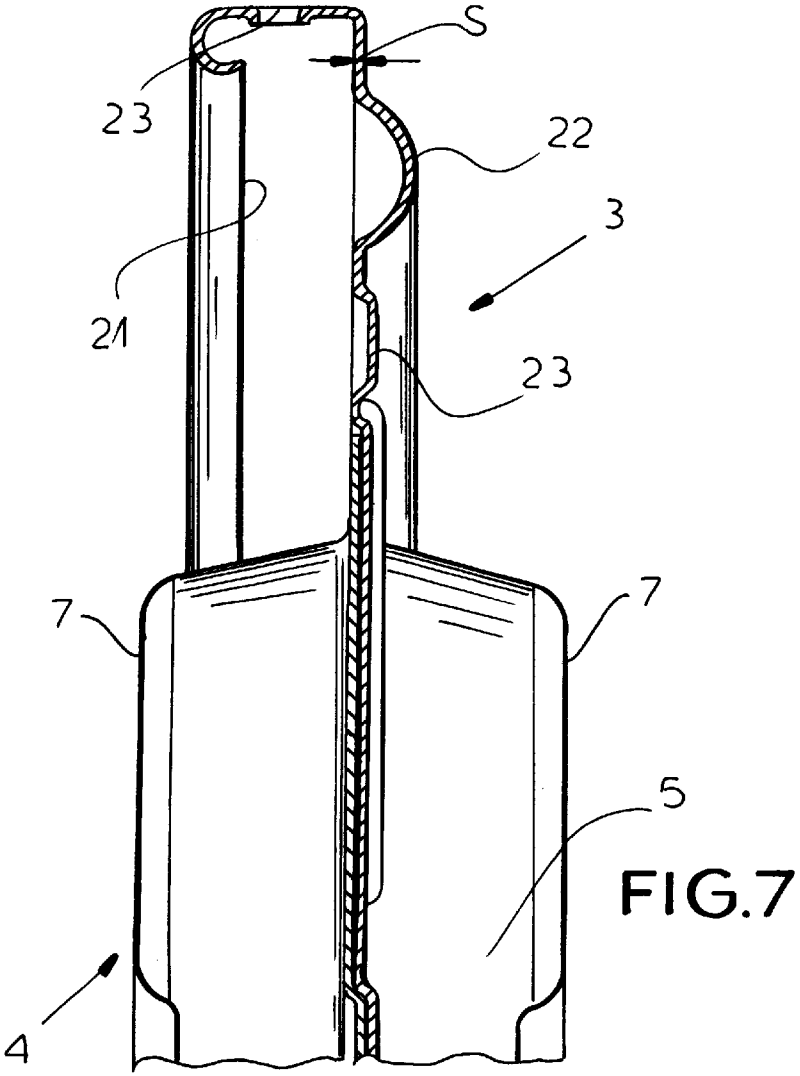
FIGS. 6 and 7 are sectional views showing respectively the first and second metal plates sectioned and mutually associated according to the invention.
Figure 6:
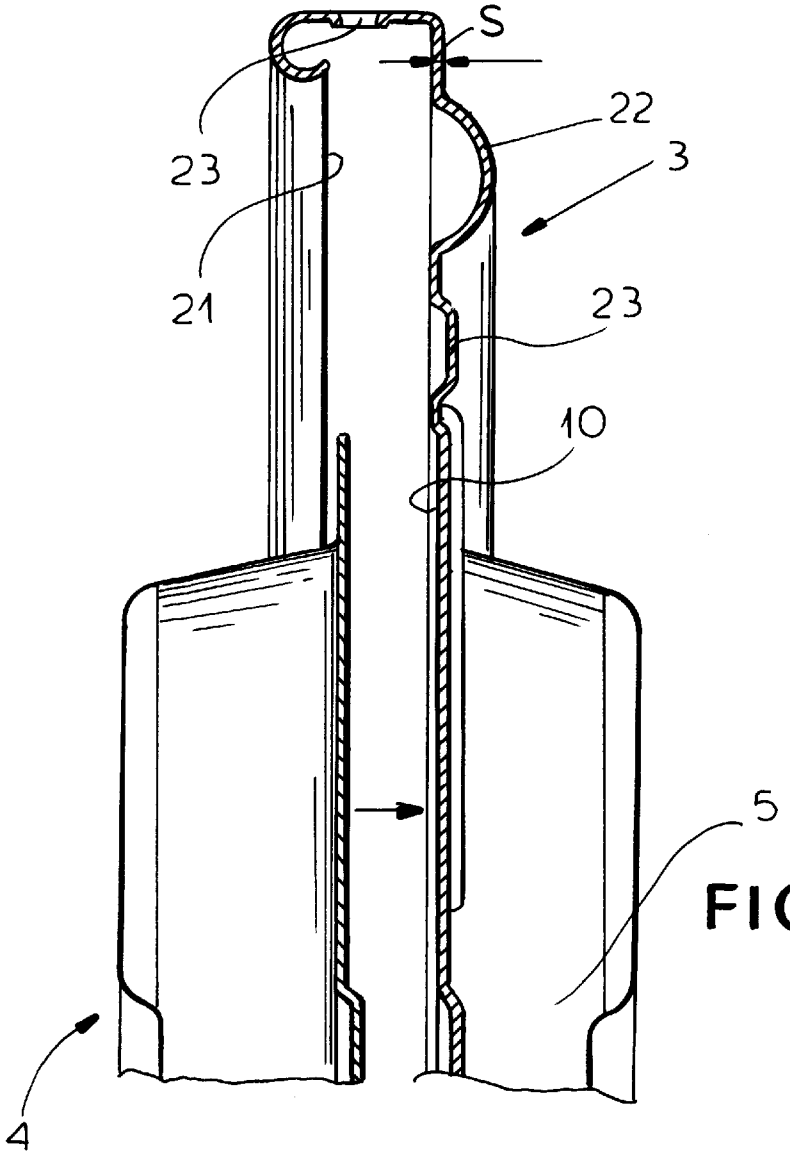

In this manner, as clearly visible in FIG. 7, once the first and second metal plates 3 and 4 are mutually associated, they allow the first plate 3 to extend beyond the central region wherein the diathermal oil circulates from a median region thereof.

The second metal plate 4 is also associated with the first metal plate 3 by an electric welding, by rolling its peripheral region inside the seat 10 formed in the first metal plate.

According to another embodiment, each radiating member has a tapered top thus having a substantially trapezoidal shape with the minor base 40 facing upwards and the major base 41 facing downwards for allowing the optimization of the convective air motion because the lower major base 41 defines a suction port of greater size than the minor base 40 and thereby the passage section of air going from the base upwards is progressively smaller thus increasing the convective flow speed.

This embodiment thus allows a greater circulation of air in the ambient thus increasing the overall efficiency of the radiator.

The above described embodiments also allow to mechanically work the first metal plate and it is for example possible to form at least a fold 20 on its peripheral portion, the fold having a ridge 21 on its edge.

Figure 4:
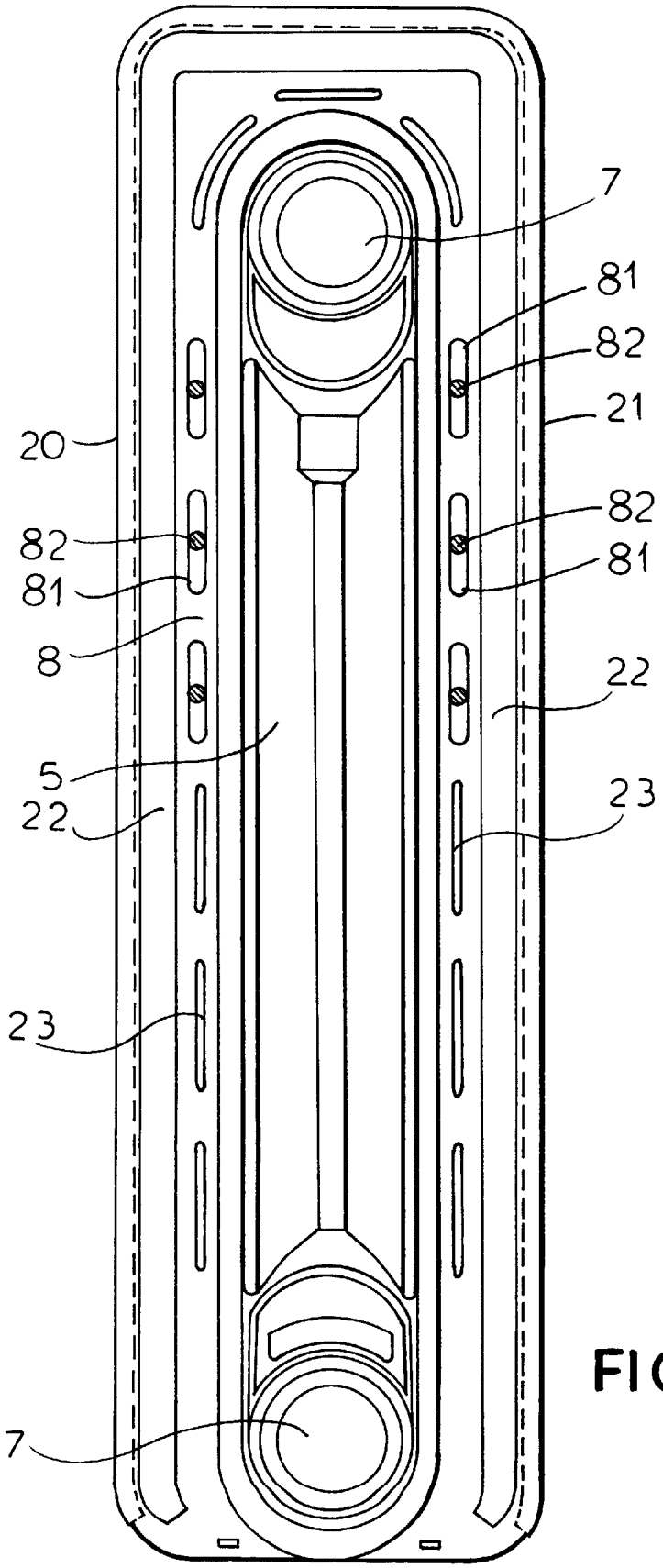
FIG. 4 is a front elevational view of a different embodiment of a radiating member of the radiator according to the invention.
Figure 5:
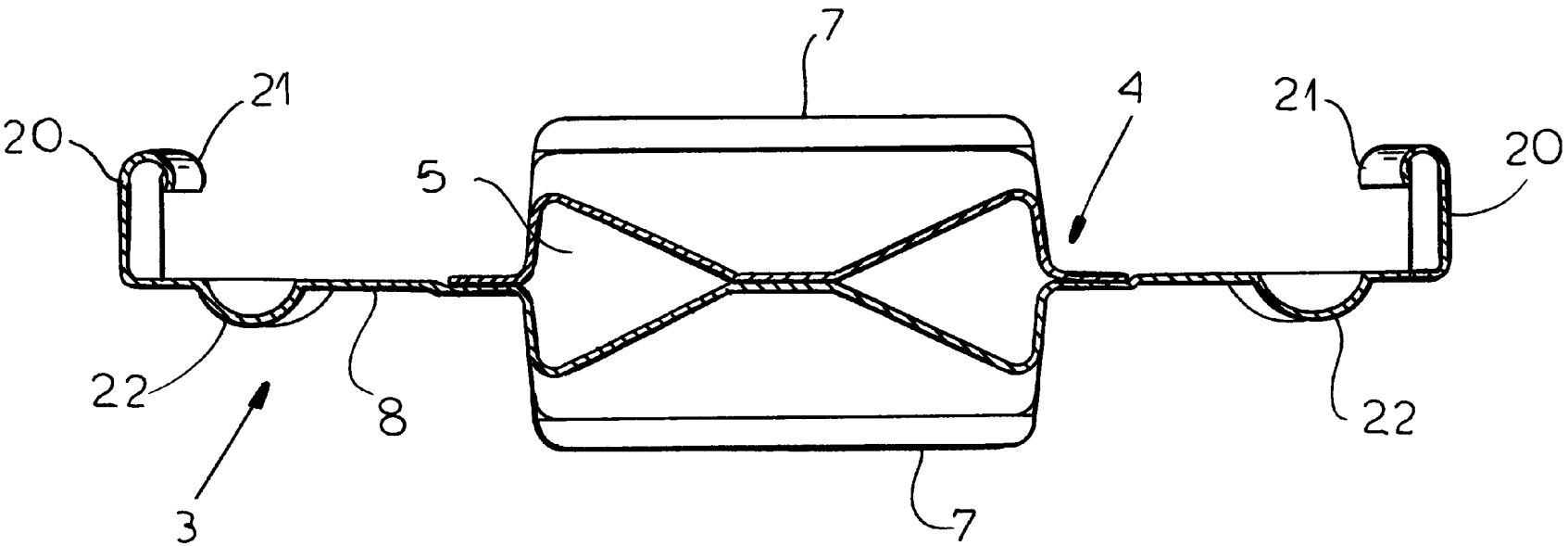
FIG. 5 is a cross sectional view of a radiating member of the radiator according to the invention.

Moreover, the first metal plate has stiffening means on its surface and heat transmission limit means receiving heat transmitted by convection from the central portion 5, where the oil circulates, to its edges. The stiffening means comprises a groove 22 extending at least along a portion of the first metal plate and in particular, as for example visible in FIG. 4, extending from the lower base along the entire perimeter of each radiating member.

The groove 22 has a semi-channel shape and also has the advantage of limiting the transmission of heat by convection from the central portion of each radiating member, because it increases the length of the path of the heat and accordingly increases the surface dissipating the heat, and because in the folded regions the sheet metal tends to be thinner thus increasing the resistance to the passage of heat.

Moreover, the heat transmission limit means may also be defined by one or more holes 23 which may be arranged parallel to the central portion where the oil circulates or at an angle or in any other suitable manner.

The buttonhole shaped apertures 23 are also conveniently provided on the upper portion of the radiator in such manner as to form a grid directly provided on the first metal plate 3 of each radiating member of the radiator in order to prevent the further manufacturing steps of the prior art such as stamping, stocking, degreasing, painting and assembling of the grids traditionally made separately from the radiating members and then associated with the radiating members once the radiator is completed.

Beside the provisions of one or more elongated holes 23, adapted to form the grid, the upper portion of each radiating member may also be formed with the fold 20 and/or the ridge 21 of the first metal plate 3 in order to create a uniform radiator body equally provided with the above mentioned thermal and functional properties.

Because of the fact that, in each radiating member, an upper space is formed between the grid surface and the hubs wherein the heated fluid flows from one member to the other one, if necessary, the radiator may be provided also with forced flow means for forcing an air flow, such as for example a fan or air humidifier means, such as for example a humidifier, not illustrated.

One or both end radiating members may be provided with a cover 90 adapted to close the body of the radiator both for styling and for preventing the contact with the heated portions of the radiator by the user.

It has been seen in practice that the radiator according to the invention is particularly advantageous in allowing to heat the room in an extremely short time further allowing, a flexible use unheard of in traditional oil radiators.

Furthermore, performing the mechanical workings only on one plate allows to perform workings that are not possible on two plates as in the prior art radiators, and allows to manufacture a radiator which weights less and is thus more easily moved from one room to the other by the user and also allows to save material in spite of improving its efficiency, the styling and the manufacturing speed in line.

The radiator according to the invention is susceptible to several modifications and variations within the inventive concept, also all the details may be substituted by other technically equivalent elements. The radiator can have a forced flow means 70 and an air humidifying means 71.

In practice, the materials employed, as well as the dimensions, may be any according to the specific needs and the state of the art.

What is claimed is:

1. A portable radiator comprising:

a body having a plurality of radiating members each defined by at least a first metal plate and a second metal plate mutually associated and by at least one central portion for circulation of a heated fluid at a preset temperature, said radiating members being mutually connected through passage hubs for said heated fluid for its circulation inside said body;

first heating means in said body for heating said fluid; and in at least one region of the surface of the radiating members external to said central portion wherein said heated fluid circulates, additional heating means at least for heating the surrounding air, said radiating members having, on said surface external to said central portion wherein said heated fluid circulates, at least one aperture adapted to define, together with apertures of the adjacent radiating members, a seat in which the additional heating means is arranged.

2. The radiator according to claim 1 wherein said additional heating means comprises at least one reinforced electrical resistance extending inside said seat.

3. The radiator according to claim 2 which comprises at least two superimposed parallel seats wherein said reinforced electrical resistance extends.

4. The radiator according to claim 3 wherein said apertures are elliptical in shape and adapted to accommodate two branches of said resistance.

5. The radiator according to claim 4 wherein said seat formed by said apertures extends along all the radiating members of said radiator body.

6. The radiator according to claim 5 wherein said at least one region of the surface external to said central portion wherein said heated fluid circulates, has a wall thickness substantially equal to the thickness of said first or second metal plates and that said first metal plate has dimensions greater than those of said second metal plate and has seating means for said second metal plate defined by a seat having a size substantially equal to the size of said second metal plate.

7. The radiator according to claim 6 wherein each radiating member has an upward tapering defining a base larger than its top.

8. The radiator according to claim 7 wherein said first plate has at least one fold at its peripheral portion.

9. The radiator according to claim 8 wherein said fold has a ridge on an edge thereof.

10. The radiator according to claim 1 wherein said first metal plate has stiffening means on its surface, and further comprises heat transmission limit means for limiting transfer of heat by convection from said central portion to said edge.

11. The radiator according to claim 10 wherein said stiffening means comprises a groove extending at least along a portion of said first metal plate.

12. The radiator according to claim 11 wherein said heat transmission limit means is defined by said groove.

13. The radiator according to claim 12 wherein said heat transmission limit means comprises a plurality of holes.

14. The radiator according to claim 1, further comprising a forced flow means for forcing an air flow.

15. The radiator according to claim 1, further comprising an air humidifying means.

* * * * *